US007059964B1

(12) United States Patent
Harpaz

(10) Patent No.: US 7,059,964 B1
(45) **Date of Patent: *Jun. 13, 2006**

(54) GAMES GRID BOARD

(76) Inventor: Yehouda Harpaz, 129 Corrie Road, Cambridge (GB) CB1 3QQ ( * ) Notice: Subject to any disclaimer, the term of this patent is extended or adjusted under 35 U.S.C. 154(b) by 801 days.

This patent is subject to a terminal disclaimer.

(21) Appl. No.: 10/031,890

(22) PCT Filed: Jul. 5, 2000

(86) PCT No.: PCT/GB00/02586

§ 371 (c)(1),
(2), (4) Date: Jan. 23, 2002

(87) PCT Pub. No.: WO01/14025

PCT Pub. Date: Mar. 1, 2001

(30) Foreign Application Priority Data

Aug. 19, 1999 (GB) ..... 9919551.3
Dec. 13, 1999 (GB) ..... 9929210.4

(51) Int. Cl.
*A63F 3/02* (2006.01)
*A63F 3/00* (2006.01)
*G06F 19/00* (2006.01)

(52) U.S. Cl. ..... 463/9; 273/429

(58) Field of Classification Search ..... 463/1, 463/9, 36, 37, 14; 273/237, 236, 267, 153 R, 273/460, 238
See application file for complete search history.

(56) References Cited

U.S. PATENT DOCUMENTS 5,417,425 A * 5/1995 Blumberg et al. ..... 273/153 R
5,603,500 A * 2/1997 Olti et al. ..... 273/153 R
5,743,796 A * 4/1998 Orak et al. ..... 463/9

FOREIGN PATENT DOCUMENTS

GB 2 334 680 * 9/1999

OTHER PUBLICATIONS

OS2World, Lites Out!, Jan. 1997, taken from Internet, http://www.os2world.com/games/html/lites_out_.html.*
Internet Archive, Othello, Feb. 1999, http://web.archive.org/web/19990210053422/http://members.aol.com/shadows125/othello.*
British Othello Federation, Rules of Othello, circa 1998, http://www.britishothello.org.uk/bof4.html.*

* cited by examiner

*Primary Examiner*—Xuan M. Thai
*Assistant Examiner*—Matthew D. Hoel

(57) ABSTRACT

A board is made of many grid points (1 & 2) arranged in a grid on a flat surface (6), and connected to a game manager (3) (a CPU+memory+software). Each grid point notifies the games manager when it is pressed, and the games manager can illuminate each grid point by one of two color. The board plays a game in which each player in his turn presses a point which causes a pattern of points around this point to be switched on with the player color if they were off, or reverse their color if they were on. The winner is the player that has more points when all the points are switched on.

2 Claims, 5 Drawing Sheets

GAMES GRID BOARD

This invention relates to board games in which a move is done by indicating a point on the board, and the state of the game is expressed in the state of the points. These include traditional games like OTHELLO (registered trademark) and Go, but also large number of other potential games, puzzles and exercises. The invention presents an electronic board to play these games, and a new game to play on it. In this document, the term 'game' includes single or multi-player games, puzzles and exercises.

Games like OTHELLO and Go are played by each player, in his turn, adding a pebble to the board, on one of the points in a grid of lines drawn on the board, or in one of the squares on the board. These games have the advantages of being based on simple playing acts and being interesting intellectually. Their disadvantages are:

1) They require somewhat tricky movement when putting the stone on the board in the right place without disturbing other stones.
2) They tend to suffer from delays when a player is thinking on a move.
3) Some of the moves require additional 'housekeeping' operations, e.g. taking stones of the board in Go or changing them to stones in another colour in OTHELLO.
4) The players need to keep the rules and do the counting of stones themselves, which puts extra demand on the players.
5) The stones are separate objects, which are easily lost.

Disadvantages 3–5 can be solved by programming a computer to display the board and stones. The program would be simple enough that it can be put on a small and cheap CPU, and hence be built into a standalone playing board. In principle, the computer could also limit the time allocated to each player, thus solving disadvantage 2.

The problem of input (disadvantage 1), however, is not solved so well by current electronic systems. That is because input for existing electronic systems is normally done through buttons, or other devices, which are separated from the display. For games where there is a small repertoire of possible different inputs this is acceptable, but for board games like OTHELLO, there are many possible different inputs (the number of points in the grid). Inputting a point on buttons off the display requires the players to perform some mental operation to convert the point they think about to the right input. This is relatively slow and error-prone process. For slow-going games that is very annoying but may be acceptable, but it makes it impossible to play fast on these systems, and for most people this is a decisive factor. The aim of the grid board is to solve this problem, by making the display of the state of the game (the board) also the place where the input from the players is received.

A possible way of achieving this is to use a flat display panel covered by a touch screen. Segmented display was also suggested as possible solution. These solutions give a very powerful combination, but they are very expensive and associated with various technical problems. For example, a prototype of the hardware of the current invention, which was implemented using a touch screen on top of an LCD screen required components that cost more than £1000, and requires calibration approximately once a week. The invention here is based on the observation that many games do not require a complex (and hence expensive) display or input mechanisms. Instead, they can be played on a simple (and hence cheap) grid of points. Once such a grid is made, it opens the possibility of playing many different games on the same grid, by avoiding any constraints on the rules of the games in the hardware, and let a CPU with a flexible program manage the behaviour of the grid.

The current invention presents the construction of such a simple grid board, and a new game, called FillIt, to play on it. The conceptual structure of the hardware of the grid board is sketched in FIG. 1.

According to the current invention (the games grid board), the user accessible part of the grid board is made of grid points 1 & 2 which arc arranged in a grid on a flat surface 6. Each grid point is a clearly visible element 1 which can detect when it is pressed, and can be illuminated in at least two colours by an illumination source 2 in or below the surface. The figure shows only 3 grid points for clarity, but the actual board has many more grid points (typically 36–1000). The figure also shows the illumination source 2 separately from the visible part of the grid point 1, which denotes the fact that pressing a grid point does not affect its illumination. All the grid points are connected to a games manager 3, which is a CPU+memory+software. When a grid point is pressed, the games manager 3 is notified (arrows from the visible part 1 to the games manager 3), and the games manager controls which sources of illumination are on (arrows from the games manager 3 to the sources of illumination 2). The games manager is programmed to manage various games. Managing a game means that the board displays the state of the game by putting on the appropriate sources of illumination 2. When a sensor 1 is pressed, the games manager computes the implication according the rules of the current game, and changes some of the sources of illumination 2 (possibly none) to reflect the new state of the game. The board may also change which sources of illumination are on when no point is pressed. One of the games played on the board is FillIt. The rules of FillIt are: Each player in his turn presses an empty point which causes a pattern of points around this point to be switched on with the player colour if they were off, or reverse their colour if they were on. The winner is the player that has more points when all the points are switched on.

To allow the users to utilise all the functionality of the board, it will need a control area 4, which allows the players to change the current game, change the rules of the current game and change other parameters, like the length of time that each player has to perform his move. The control area 4 also displays the current score of the game. Typically, the control area will contain few control buttons and an alphanumeric display. The games manager receives information from the control area about which control buttons were pressed, and controls what is displayed in the alphanumeric display.

The basic functionality of the games manager comprises these actions:

1) When the users indicate through the control area 4 that they want to change the current game or any of the parameters of the current game, the game manager sets its own internal state to the new value, and indicates to the users the new value.
2) When one of the grid points is pressed and the current game and parameters make it illegal for the current player to press some of the points, the games manager checks if the pressed point is allowed according to the rules and parameters of the current game and the current state of the game (i.e. which points are illuminated). If the pressed point is not allowed, the games board may issue some indication that an illegal point was pressed, may indicate why it is not allowed by some message through the control area 4, and may indicate which points are allowed (e.g. by flashing them). Note that illuminated points, while typically are not allowed, may be allowed in some games (for examples, see Life1, Life2 (p. 9), ClearIt (p. 10) and FillIt on p. 2; "Life" is an RTM).

3) When a point is pressed and it is allowed according to the current rules, parameters and state of the game, the games manager computes the implications and then changes the illumination of some (possibly zero) points to reflect the new state of the game. Note that:

a) While typically the point that is pressed changes its illumination, this is not mandatory. For example, in the game FindThem (p. 10) the pressed point changes only if it is was illuminated in the right colour earlier, and in the game ClearIt (p. 10) the pressed point never changes.

b) Other points except the pressed point may change as well, e.g. points that are caught in OTHELLO and Go. In other games, every move changes some other points, e.g. the games ClearIt (p. 10) and Fillit (p. 2).

4) If the rules of the current game require it, the games manager changes the illumination of some points even when none of the points is pressed, typically once each some time period (or 'generation'). For examples, see the games Ghost, TouchIt, Life1 and Life2 on p. 9.

5) After each change to the illumination of any grid point, the games manager computes the current score and displays it using the control area 4.

6) After each change to the illumination of any grid point, the games manager checks, using a game-specific routine, if the game is finished. If the game is finished, the games manager indicates it, typically by some message in the control area 4, and maybe other additional signals. In some cases, finishing the game may involve some changes to the illumination of the grid points. For example, when Visiput (p. 10) reaches a finished position, i.e. it is clear what unilluminated points belong to which colour, the games manager illuminates all the points with the colour they belong to.

The board will also need a way to signal whose turn it is, which would typically be done by two turn lights 5, which are in two separate colours, corresponding to two of the colours of the illumination in the grid points. The games manager controls these turn lights, and signal to the players whose turn it is by switching the corresponding turn light.

The kind of games that the board will be programmed to play include (but not restricted to):

1) Traditional games like Go and OTHELLO, with the addition that the time allocated to each move can be limited, and that the games manager can be set to 'salt' the game by doing random changes to the board. The board is particularly useful for OTHELLO, in which the old-style board requires the players to reverse the colour of 'stones' in each turn. With the games grid board, this is done by the games manager.

2) Other two-player games between two human players or between a human and the games manager. Because the games manager checks the legality of moves, performs all the changes and computes the score, these games can have rules that require complex legality checks, extensive changes and difficult score calculations but still be easy to play, which opens many new possibilities. Examples include the games Visiput (p. 10), where checking the legality of a move is difficult to humans, CountLines (p. 10), where computing the score correctly would be difficult for humans, and FillIt (p. 2), where each move involves large changes to the board. All these games, which apart from these problems are simple and intellectually interesting, are effectively impossible to play without the games manager.

3) Puzzles and single-player games. For examples see the games TouchIt and Symmetry on p. 9.

4) Fluid games, which means games where the patterns of illuminated points changes even when the player(s) don't press any point. For examples see the games Life1 and Life2 on p. 9. TouchIt and Ghost (p. 9) can also be regarded as a fluid game. Currently, there is no realistic way to implement these kind of games.

5) Memory games. See for example the game FindThem on p. 10.

The games manager can be programmed to help the players to find which points are legal moves, typically by transiently illuminating (flashing) these points with the colour of the player. This needs to happen in response to some input, for example a player pressing a point which is illegal move. This is specially useful for novice players, which with this feature set on can learn to play a game simply by trying to play it.

Because the behaviour of the board (i.e. which points are illuminated) is completely controlled by the games manager 3, what games can be played and what parameters can be changed is completely determined by the software of the games manager, which would normally be stored in some kind of ROM. Even with a modest size ROM of 32 kb, it is possible to store large number of games, with many settable parameters (the 12 games listed below use 26 kb, including the main loop and the general code to display and set parameters), and the size of the ROM can easily be made larger so it can accommodate many more games. The number of possible games that can be played with the same board can be made indefinitely large by making it possible to load new games into the board. This can be done by making the ROM replaceable, or by adding a device to load software from a removable medium like a floppy disk.

The large variability of games that can be played on the same individual board means that the same board would be entertaining and interesting to a large variety of people. Experience with a prototype suggests that at least some of the games appeal to any age range from 4 years old to adults.

The arrangement of the grid points would be in most cases square, but can also be of different shapes (e.g. rectangular, hexagonal, triangular or less regular). The overall shape of the board can also vary.

The game FillIt is a new kind of game, which can be played on the board. As described above, in its turn the board change some of the points around the point that the player pressed, according to some pattern. FIGS. 4 and 5 show several possible patterns. The small squares mark the point that the player pressed, and the crosses mark points that are affected.

In general there is no limit to the complexity of patterns that can be used, and they don't have to be symmetrical. However, experience showed that relatively simply patterns with high symmetry already give interesting games, and more complex and asymmetric patterns make the game too complex.

In the most general form of the game it requires definitions of six patterns, one for each possible change of illumination, which is probably too complex for the players. However, this can be simplify by never switching off points, and never changing unilluminated points to the colour of the other player. That leaves three patterns: One that defines which empty points will be switched on with the current player's colour, a second that defines which points of the current player's colour change their colour to the other colour, and a third that defines which points of the other player's colour change to the current player's colour. This can be simplified further by making two or all the three patterns be the same.

An additional possible variation is whether the players are allowed to press illuminated points, or are they allowed to press only unilluminated points.

A specific embodiment of the invention will now be described with reference to the accompanying drawings.

Figure 1:
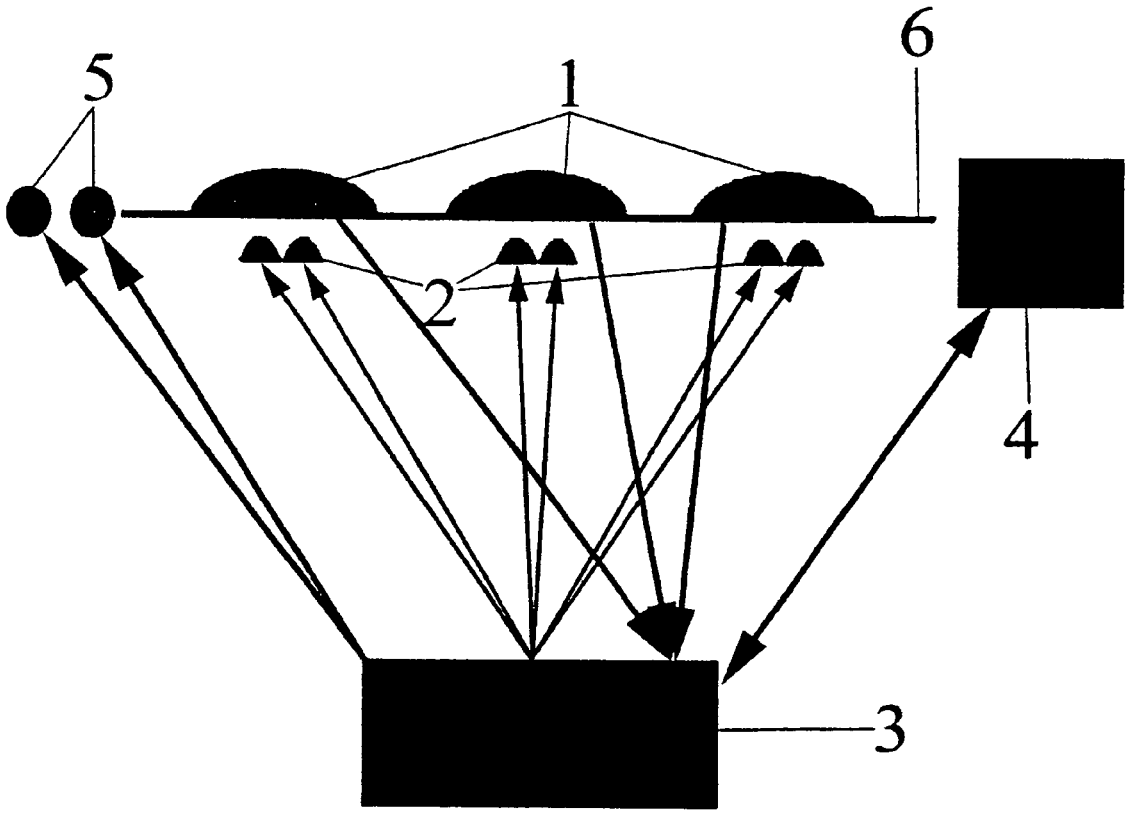
FIG. 1 shows the conceptual structure of the board.
Figure 2:
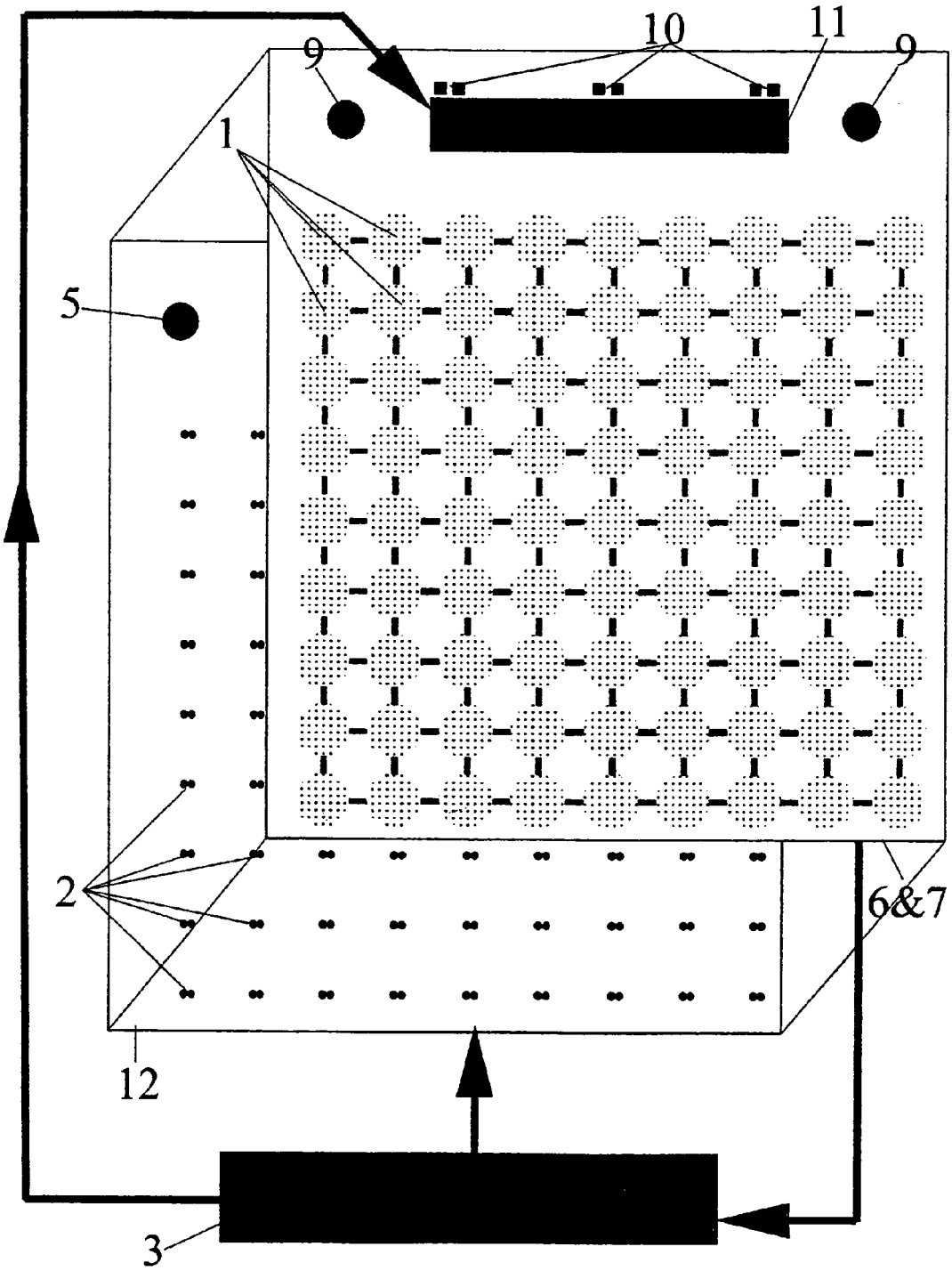
FIG. 2 shows a sketch of the electronic components of an example board.

The inputs of grid points 1 are implemented by a custom-design membrane keyboard 7 on a PCB 6, which together comprise the top of a flat rectangular box. The membrane keyboard contains a grid of 9×9 translucent buttons 1, which are in a shape of small domes. Between the buttons the membrane is painted with lines 8 drawn on the imaginary lines connecting the centers of the buttons. The PCB 6 has holes below each button, with additional holes 9 for the turn lights. Both the PCB 6 and the membrane keyboard 7 has a hole for the alphanumeric display 11.

The illumination of the grid points is implemented by 9×9 pairs of LEDs 2 mounted on a PCB 12, which is itself mounted below the membrane keyboard such that each LEDs pair 2 is under the centre of one of the buttons 1. In each pair one LED is of one colour (e.g. green) and the other of another colour (e.g. red). Alternatively, each LEDs pair can be replaced by a bi-colour LED. The two turn lights 5 are implemented by two large LEDs, one in one of the colours of the pairs of LEDs 2, and one in the other colour, mounted on PCB 12 as the rest of the LEDs. The electronic circuitry to drive the LEDs 2 and the turn lights 5 is also on PCB 12.

The membrane keyboard 7 also contains several control buttons 10, which allow the users to control the game (start, stop etc.) and to select which game is played and set parameters for the current game. An alphanumeric display 11 is mounted in a hole in the membrane keyboard 7. The control buttons 10 and the display 11 together comprise the control area 4 of FIG. 1.

All the input from the membrane keyboard goes to the games manager 3, which is a small CPU (around 5 MIPS) and a little ROM and RAM (around 32 Kb and 6 Kb respectively). The games manager 3 is placed below the LEDs PCB 12. A custom design electronic circuitry (denoted by arrows from the membrane keyboard 7 to the games manager 3, and from the games manager 3 to the PCB 12 and to the display 11) allows the games manager 3 to switch on and off each individual LEDs, and to display the appropriate information in the alphanumeric display.

Figure 3:
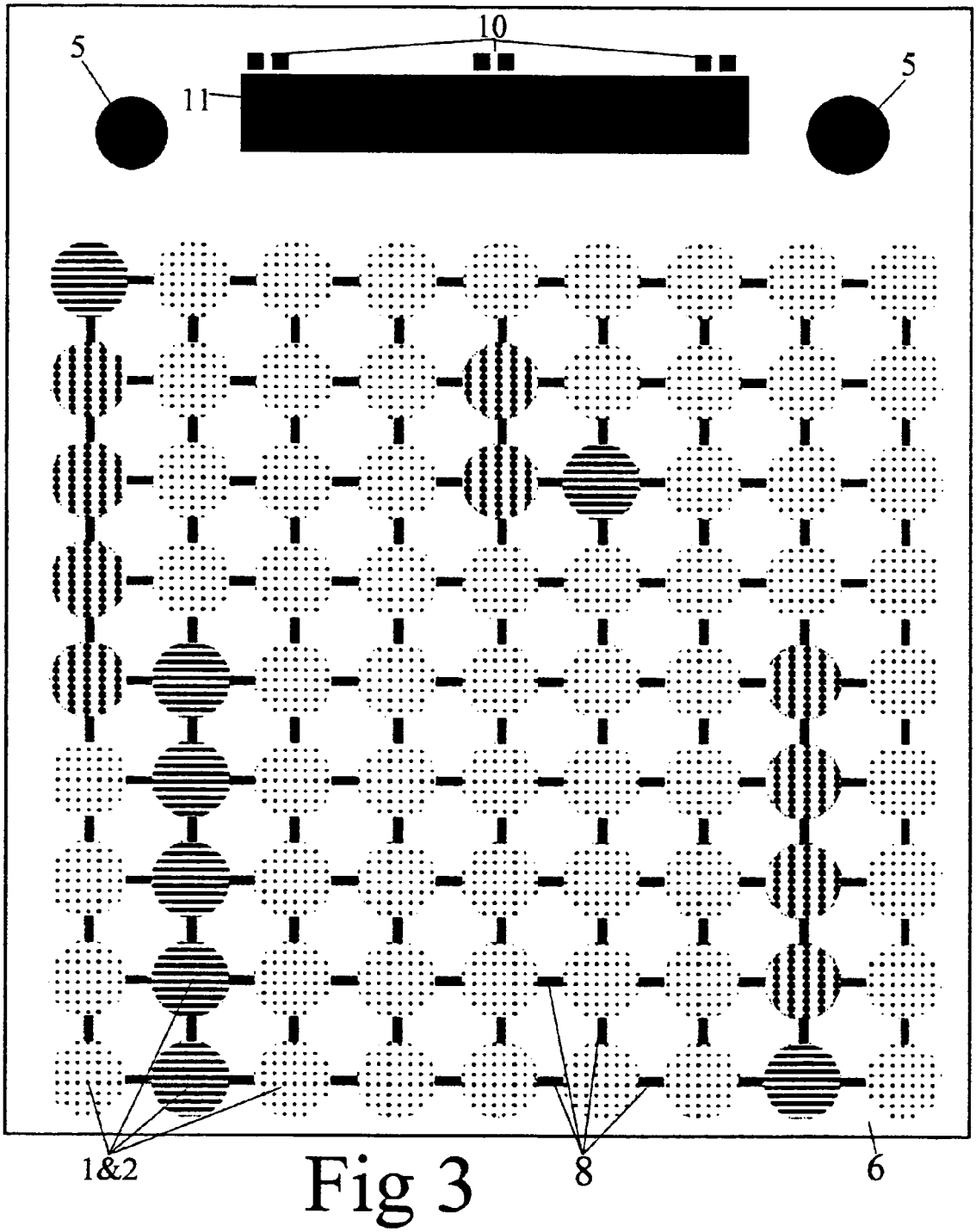
FIG. 3 is a sketch of the way the board looks for players from above.

FIG. 3 shows a sketch of the board from above in a middle of a game, with some grid points illuminated. Most of the grid points are not illuminated (circles with points). Some of the points are illuminated in one of two colours (indicated in the figure by two different shading). Because the buttons are translucent (rather than transparent), the LEDs 2 are not actually visible.

The embodiment of the grid points which is described above seems to be the most effective with current technology, but some parts can easily be changed if and when other technologies improve or new technologies become available, without affecting the overall design of the board. The detection of pressing a grid point may be done by any discrete input device, for example standard contact switch and capacitive switch. The illumination of the grid points can be done by other kind of sources, for example gas-discharge lamps and incandescent lamps.

In the embodiment which was described above the players press the grid points with their fingers. This is very convenient, which is one of the advantages of the board. However, it has a problem that the board cannot distinguish which player is pressing a point, so the players can press a point out of their turn. The possible solutions to this problem seem to be too cumbersome and in some cases too expensive, so they are not included in the preferred embodiment. However, some of the solutions may prove to be convenient and cheap enough to be acceptable, and if the board is used for formal tournaments it may become an essential requirement.

A cheap and simple solution is to add two buttons on two sides of the board, one for each player, and the player will need to either hold down his own button while pressing a point or to first press his button and then press the point.

Another solution is to have two probes connected to the board, and the players use them to press the points. The contact between the probe and the board creates a short circuit which the board detects and hence can tell which probe, and hence which player, presses the point. An advantage of this solution is that it means that the sensor in each grid point can be a simple conducting element, instead of the membrane keyboard which is described above, which may make the board actually cheaper. Alternatively this method can be used to detect which player presses a point, in combination with another method to detect which point is pressed. For example, a membrane keyboard can be coated with a conducting layer, and the short circuit is caused when the probe touches this layer. In this case the membrane keyboard will detect which point is pressed, and the short circuit detects which player presses it.

Another variation of this solution is that the board emits some signal (electromagnetic or maybe ultrasound), and the probe detects this signal, and the probe that detects the signal more strongly is the one that actually presses. In this case the probe does not need to touch the board, so may be worn by the players, rather than held, which is more convenient. Another variation is that the probe interferes with or reflects the signal, and the board uses this response to detect which player presses the board. In this case, the probe does not need to be connected to the board. Alternatively, the probes themselves may emit different signals.

The solution above requires the players to hold or wear an object, which is uncomfortable. A possible solution is to mark the fingers of the players, by some material that adhere to the skin, and that the board can detect. Even more advanced technology may be able to recognise the fingers of the players directly.

The Software

The central loop of the software repeats these four steps:

1) Check if any of the control buttons was pressed. If any control button was pressed, perform the appropriate operation (change the game, set a parameter, stop the game, start the game).
2) Check if any of the grid points was pressed. If so, compute the implications according to the rules of the current game, perform all the changes to the board, and then switch the turn to the other player. The computations for the game Go are given below as an example. Switching the turn means switching the turn light of the current player off, setting the internal variable current_player to the other player, switching the turn light of the other player on and setting a variable, the turn end mark, to the current time plus the turn time.

3) Check the clock and compare it to various time marks. A time mark is a variable set to some value, which is compared to the current time. The most important is the turn end mark, and if this is passed, switch the turn as in 2. Other time marks are for updates of the displays.

4) Check if there are game specific operations to perform. If a player plays one of the two-players games against the board, this check perform the board's move. In the fluid games Ghost, Life1, life2 and TouchIt this is used to perform the generation change in the Life games, adding a point in TouchIt, and moving the Ghost in Ghost.

The Game FillIt

In the example board, the patterns are defined in this way: one parameter defines the shape of the pattern, as one of several options. The options include a '+' shape (the pattern around point 15 in FIG. 4), a 'X' shape (pattern around point 16), a combination of both (points 17 and 18) and several others. Another parameter defines the distance for the pattern. For example, the pattern around point 15 is defined by shape '+' and distance 2. If the distance is set to 1, then only the closest four points would be included in the pattern, while if the distance is set to 3, additional four points would be included, one in the end of each arm of the '+'.

The board allows the players to define two patterns: one that defines which of the points of the current player's colour are affected (the current pattern), and one that defines which of the points that are unilluminated or illuminated in the other player's colour are affected (the empty-and-other pattern). Each of these patterns is defined by a distance and shape parameter as described above.

Figure 4:
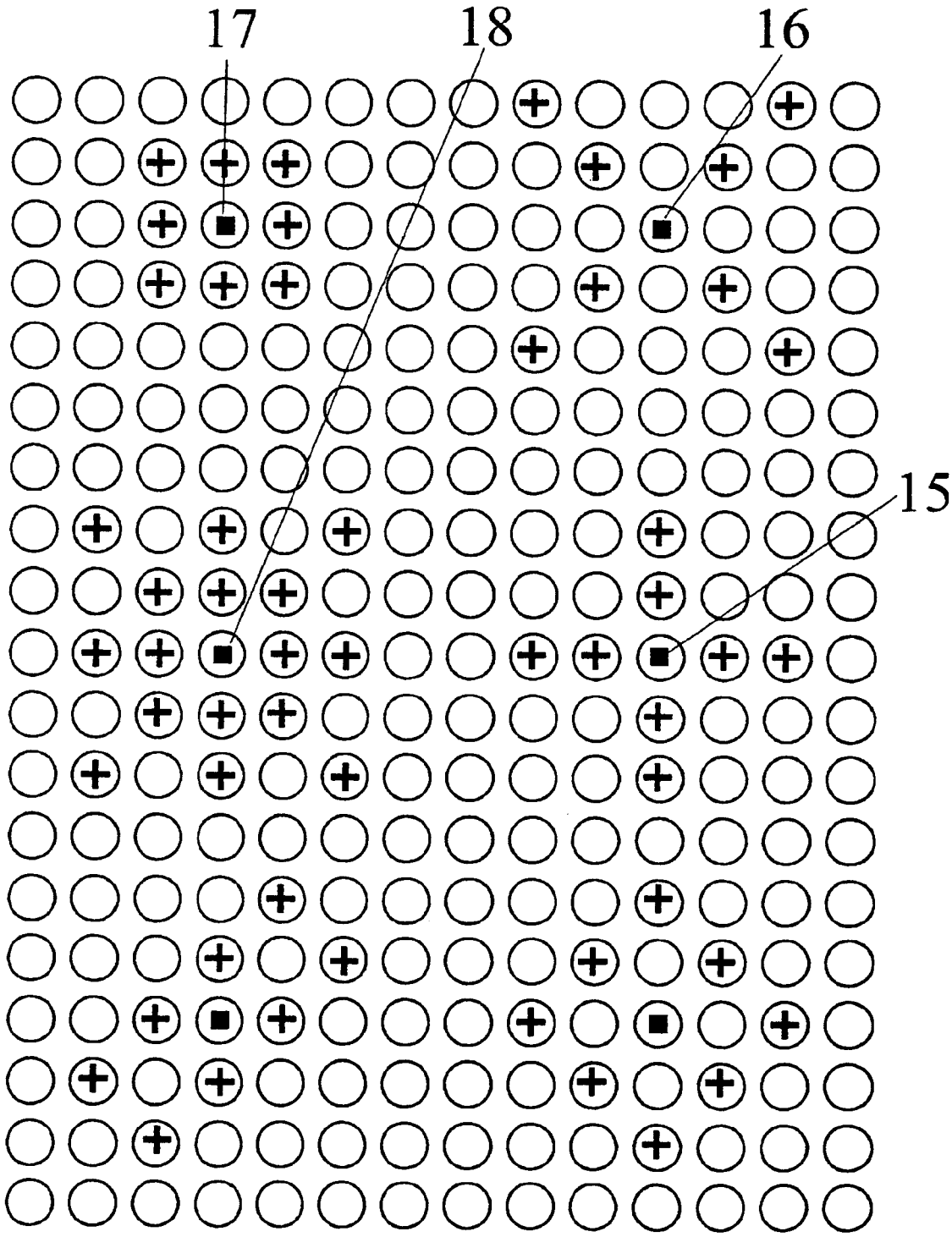
FIG. 4 shows some possible patterns that can be used in the game FillIt.
Figure 5:
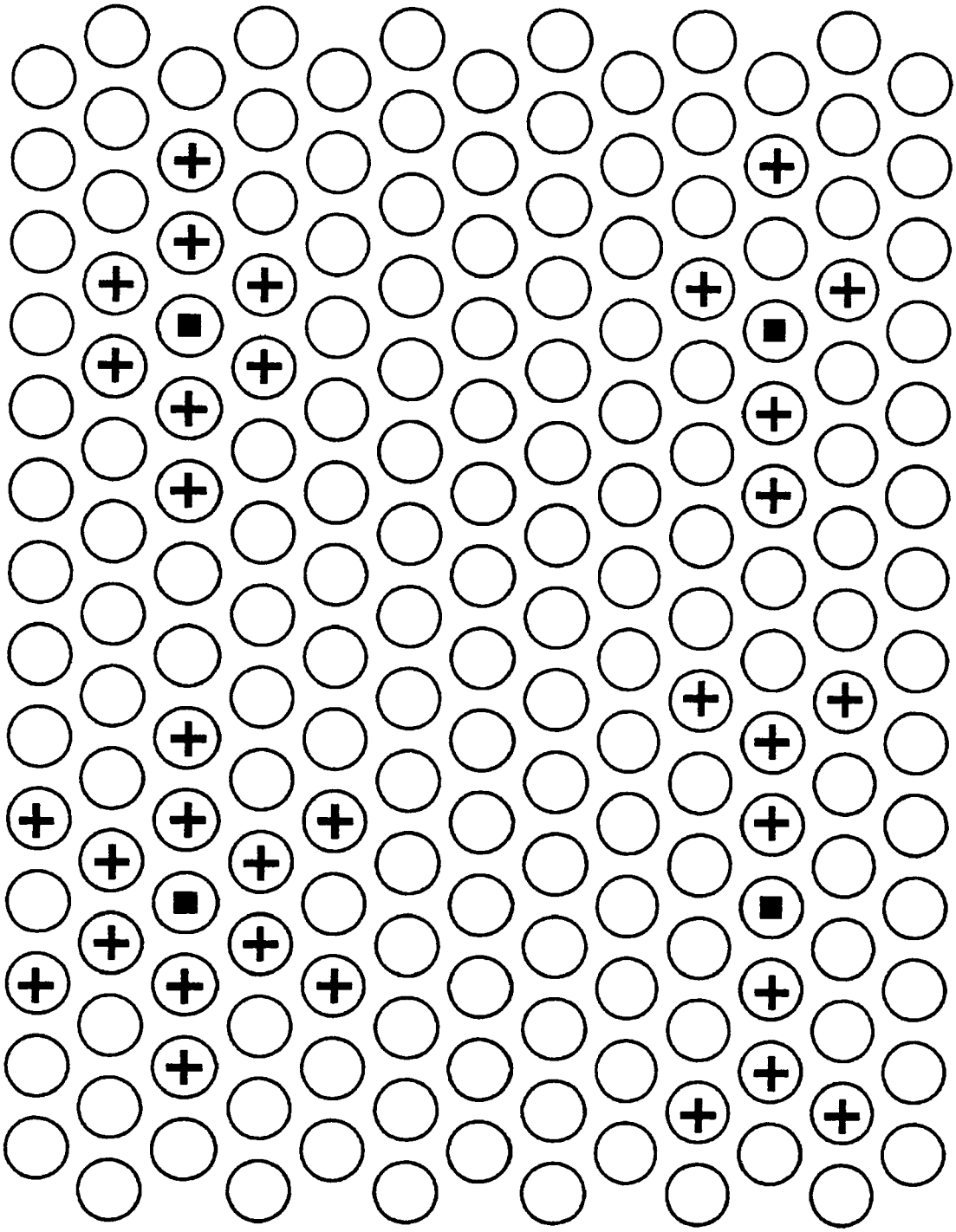
FIG. 5 shows possible pattern for hexagonal board.

The default setting is for both patterns to be the combination of '+ and 'X' shape, with the distance for the current pattern set to 1, giving the pattern around point 17 in FIG. 4, and the distance for the empty-and-other pattern set to two, giving the pattern around point 18. By default, only unilluminated points are legal moves, and that can be set by the players.

To avoid situations in which both players don't want to play, additional rule is that if a player misses his/her turn, when the other player plays his/her next move, none of the other player's points change their colour. Thus missing a move is almost always a bad move.

To add interest to the game, the game starts with a small number of randomly selected points illuminated, thus making each game different. The number of these points is controlled by the players, and defaults to 12.

When a grid point is pressed in the game FillIt, the software performs these steps:

a. Switch of the turn light of the current player and set a short (Current time+~500 ms) delay mark.

b. If only unilluminated points are legal, check if the point is illuminated. If it is, reject the move, which means notify the players via the character display, switch on the turn light of the current player on and return to the main loop.

c. Go through all the points around the pressed point which are defined by the empty-and-other pattern, and for each point of these points that is unilluminated or illuminated with the other player's colour, illuminate it by the current player's colour.

d. Unless the other player just missed a move, go through all the points around the pressed point which are defined by the current pattern, and for each point of these points that is illuminated in the current player's colour, illuminate it by the other player's colour.

e. Switch on the colour of the current player in the pressed grid point.

f. Check if the game is finished, i.e. all the points are illuminated. If it is, end the game.

g. Update the digit display to show the new count of points for each player.

h. Wait until the delay mark which was set in step (a) passes.

i. Pass the turn to the other player, i.e. switch the turn light of the other player on and set the time mark (current time+the time for a move) for this player.

Other Games Implemented in the Prototype of the Grid Board

In addition to FillIt, the following 11 games have been implemented in the prototype of the board. Each game has several parameters that can be set, but only a minority of these are described here. Each two-players game can also be played against the board. With the default parameters settings, Othello, CountLines and Visiput flash the legal moves for a player that presses a point that is an illegal move.

1) Othello. 'Adding a stone' is done by pressing an unilluminated point. If this is a legal move, the games manager switches the point on with the current player's colour (which corresponds to putting a stone in this point) and reverses the colour of the points that need to be reversed according to the rules of OTHELLO. Because the number of points is 9×9 rather than the usual 8×8, the start up position is different from the standard starting position. In each move the games manager checks if the current player has a legal move, and if not passes the turn to the other player. If both players don't have a legal move, the games manager finishes the game. In OTHELLO, passing a move is actually is illegal, but the timing of a move by the games manager means that a player may intentionally pass, which may be regarded as cheating. To get over this problem, a parameter called Compensate can be set, so when a player passes a move, the other player gets as a compensation more than one move.

2) Ghost. This is a fluid game. The board illuminates four points (the Ghost), and then moves the Ghost, by repeatedly switching on a point that is a neighbour of one of the illuminated points, and switching off one of the illuminated points. The players try to 'catch the Ghost', by touching one of the illuminated points.

3) Life1. This is a fluid game, i.e. the state of the illumination of grid points changes even if the players do not play. Each fixed time period (generation, a settable parameter), the games manager checks for each point how many of the eight points around it are illuminated, and accordingly decides if the point is going to be illuminated in the next generation. Thus the pattern of illumination of the grid points changes each generation. This is implemented by setting a time mark for a generation period and the game specific check (step 4 in the central loop) performs a generation step when the mark passes. In parallel, the player(s) can switch on or switch off points by pressing them.

Life1 can be played in a 'kill' mode, in which the player tries to 'kill' the board, i.e. switch off all the points, as fast as possible, or in 'keep alive' mode, in which the player tries to keep the board 'alive', i.e. keep at least some points on, as long as possible. Adjusting the various parameters makes the task an interesting challenge.

4) Life2. Like Life1, but the points are of two colours, and each player tries to switch off all the points of the other colour.

5) TouchIt. Single player game, mainly testing reaction time and accuracy. The games manager switches on a few points (1–4) one after the other with a short time gap, and then switches them off. The player needs to press the last point that was switched on before the next point is switched on or all of them are switched off. By changing the time gap between switching the points on, the number of points and their pattern, the player can fit the game to his own level to make it a good challenge.

6) Symmetry. Single player game. The games manager switches on a pattern of points on one side of the grid, and the player needs to press the symmetry related points on the other side of the grid. Parameters like the number of points in the pattern, the time that is allowed for doing the copying and the kind of symmetry operation that the player need to do are used to match the difficulty level of the copying to the level of the player.

7) ClearIt. The game starts with an equal number of points illuminated in each of the two colours, but otherwise randomly distributed on the grid. Each player in his turn presses an empty point, and the games manager switches of all the points of the other player's colour which are a chess knight move away from the pressed point, and points of the current player's colour which are one diagonal move further. The winner is the player that switches off all the other player's points first. This game is an example of a game when pressing a point never affects its illumination.

8) FindThem. A memory game. In the beginning of the game the games manager switches on an equal number of points in both colours but in a random pattern for a short period of time, and then switches all of them off. Each player in turn tries to switch on a point of his own colour by pressing a point. If this point was switched on with his colour in the beginning, it is switched on. The winner is the player that first switches on 9 points.

9) CountLines. Each player in his turn switches on a point of his colour by pressing it. A player is not allowed to press in two successive turns two points that are too close to each other (the distance is a settable parameter). The winner is the player that when all the points are switched on has the larger number of straight lines of four points of his colour.

10) Visiput. Each player in his turn switches on a point by pressing it. A player is allowed to press a point only if the point is 'visible' by points of his own colour at least as it is 'visible' by points of the other colour, where 'visible' means connected by a straight line of switched-off points. The winner is the player that succeeds to switch on more points. The games manager checks the games after each move, and if it can determine for each unilluminated that only one player would be able to press it, it switches on all the unilluminated points to the colour of the player that can press it, and finishes the game, thus saving the players the boring task of switching all the unilluminated points after the result of the game is already known.

11) Go. Like in Visiput, the games manager finishes the game when it is clear which part of the grid is controlled by whom. Because this is a complex operation in Go and the heuristics that are used may get it wrong, this feature is controlled by several settable parameters, and can also be switched off.

The invention claimed is:

1. An electronic board comprising a grid of grid points on a flat surface, where each grid point is a visible element which is capable of detecting when it is pressed, and an illumination source inside or below the surface which is capable of illuminating the visible element by either of two colours;

which exhibits a behaviour which makes it useful for playing various games;

and in one of these games the behaviour of the board is as follows:

the board keeps a record of the current player's colour, which is one of two colours above;

when a grid point is pressed, the board changes the illumination of a pattern of grid points around this grid point to the current player's colour if they were switched off, or reverses their colour if they were on, and then changes the record of the current player's colour to the other colour;

when all the grid points are switched on, the board declares as the winner the player of the colour of the majority of the grid points.

2. A board as described in claim 1, where the grid is square, and when an unilluminated grid point is pressed the board responds as follows:

points that are illuminated in the current player's colour and are 1 point away from the pressed point on a line of the grid or a 45 degrees diagonal line become illuminated in the other colour;

the pressed point and all the points that are unilluminated or are illuminated in the other colour and are 1 or 2 points away from the pressed point on a line of the grid or a 45 degrees diagonal line become illuminated in the current player's colour.

* * * * *